US005269830A

United States Patent [19]

Rabin et al.

[11] Patent Number: 5,269,830

[45] Date of Patent: Dec. 14, 1993

[54] PROCESS FOR SYNTHESIZING COMPOUNDS FROM ELEMENTAL POWDERS AND PRODUCT

[75] Inventors: Barry H. Rabin; Richard N. Wright, both of Idaho Falls, Id.

[73] Assignee: The United States of America as represented by the United States Department of Energy, Washington, D.C.

[21] Appl. No.: 603,650

[22] Filed: Oct. 26, 1990

[51] Int. Cl.[5] ..... B22F 9/00

[52] U.S. Cl. ..... 75/246; 419/23; 419/38; 419/39; 419/45; 419/49; 419/57; 419/60

[58] Field of Search ..... 419/45, 49, 23, 38, 419/39, 57, 60; 75/246

[56] References Cited

U.S. PATENT DOCUMENTS 4,762,558 8/1988 German et al. ..... 75/246

5,015,440 5/1991 Bowden ..... 419/45

*Primary Examiner*—Stephen J. Lechert, Jr.

[57] ABSTRACT

A process for synthesizing intermetallic compounds from elemental powders. The elemental powders are initially combined in a ratio which approximates the stoichiometric composition of the intermetallic compound. The mixed powders are then formed into a compact which is heat treated at a controlled rate of heating such that an exothermic reaction between the elements is initiated. The heat treatment may be performed under controlled conditions ranging from a vacuum (pressureless sintering) to compression (hot pressing) to produce a desired densification of the intermetallic compound. In a preferred form of the invention, elemental powders of Fe and Al are combined to form aluminide compounds of $Fe_3Al$ and FeAl.

35 Claims, 12 Drawing Sheets

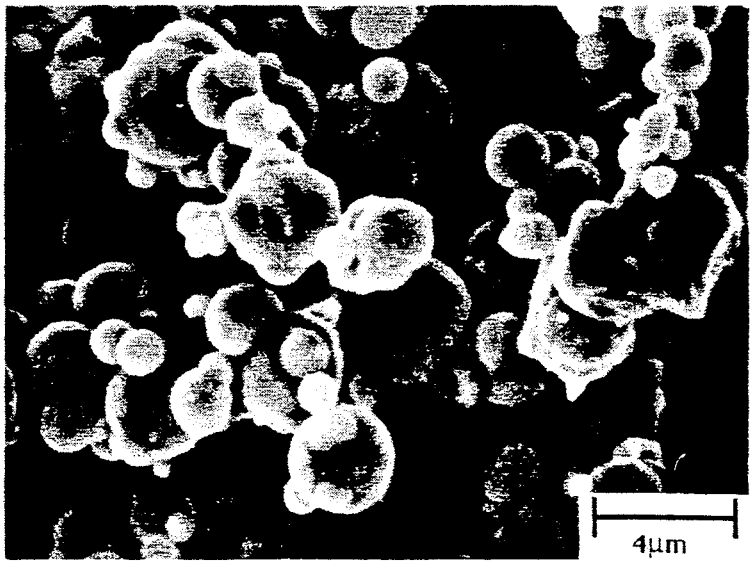
FIG. 2a IRON POWDER
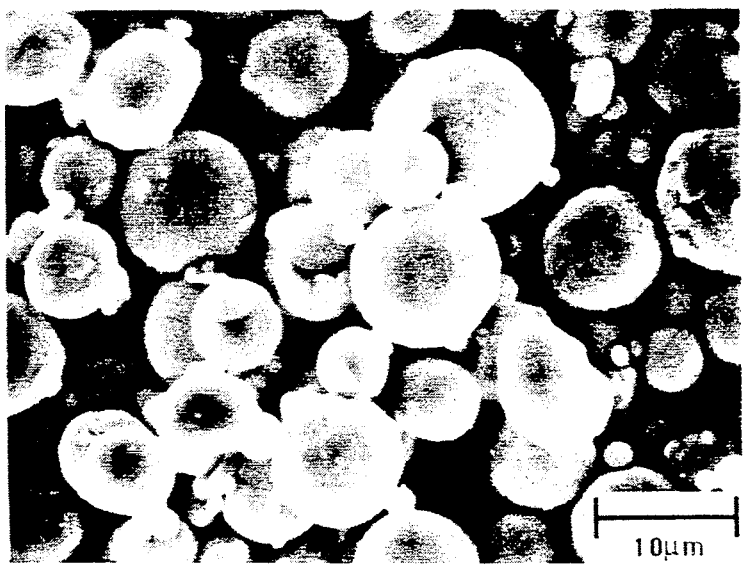
FIG. 2b ALUMINIUM POWDER

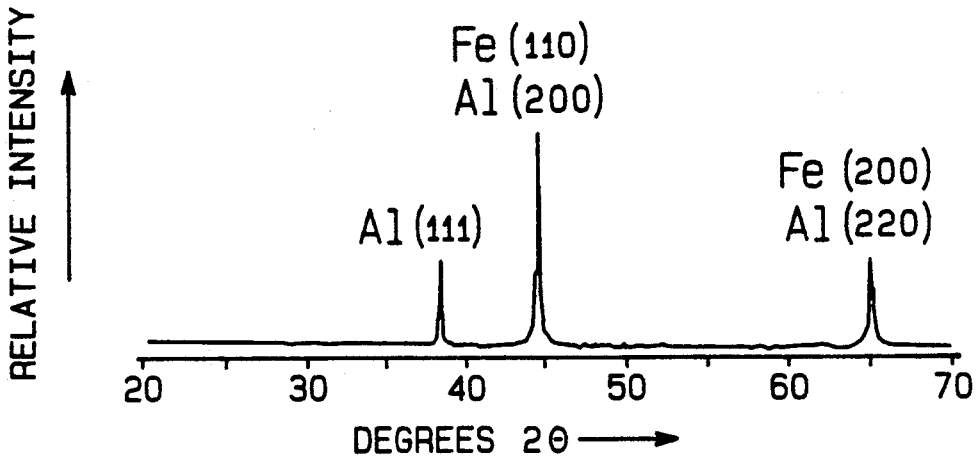
FIG. 5a MIXTURE OF STARTING POWDERS
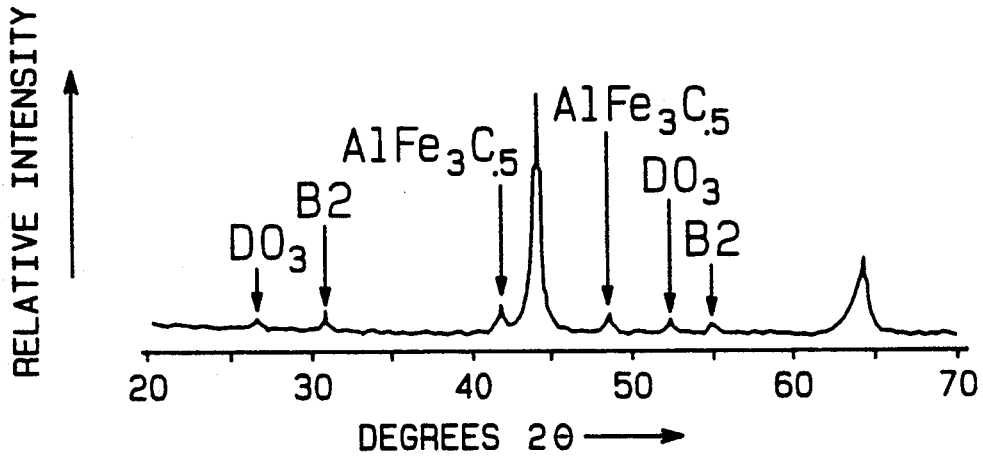
FIG. 5b REACTION HOT PRESSED Fe-15.8 Al
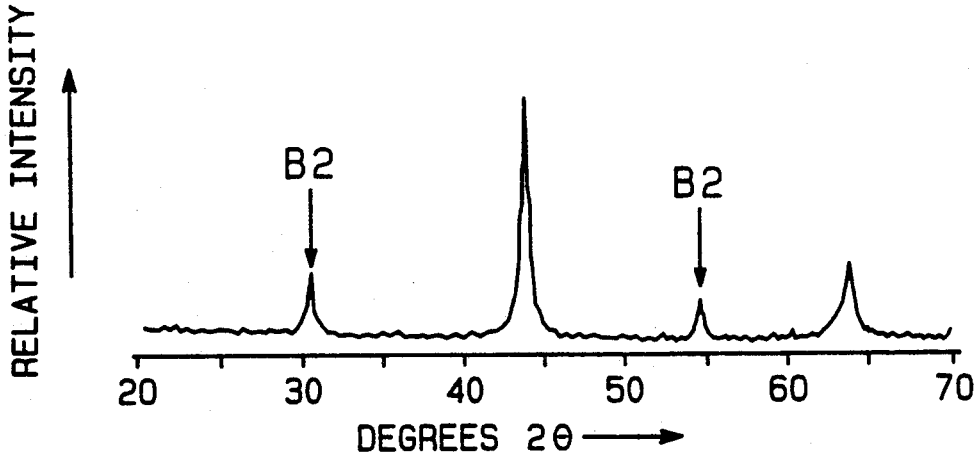
FIG. 5c REACTION HOT PRESSED Fe-32 Al QUENCHED REACTION ZONE IN Fe-15.8 Al

CENTER OF THE REACTION ZONE (REGION 2)

THE LEADING EDGE OF THE FRONT (REGION 1)

THE TRAILING EDGE OF THE FRONT (REGION 3)

DENSIFICATION AND SINTERED DENSITY FOR PRESSURELESS SINTERED Fe-15.8 Al COMPACTS SHOWN AS A FUNCTION OF GREEN DENSITY FOR TWO HEATING RATES. THE ALUMINUM PARTICLE SIZE WAS 3$\mu$m.

DENSIFICATION AND SINTERED DENSITY FOR PRESSURELESS SINTERED Fe-32 Al COMPACTS SHOWN AS A FUNCTION OF GREEN DENSITY FOR TWO HEATING RATES. THE ALUMINUM PARTICLE SIZE WAS 3$\mu$m.

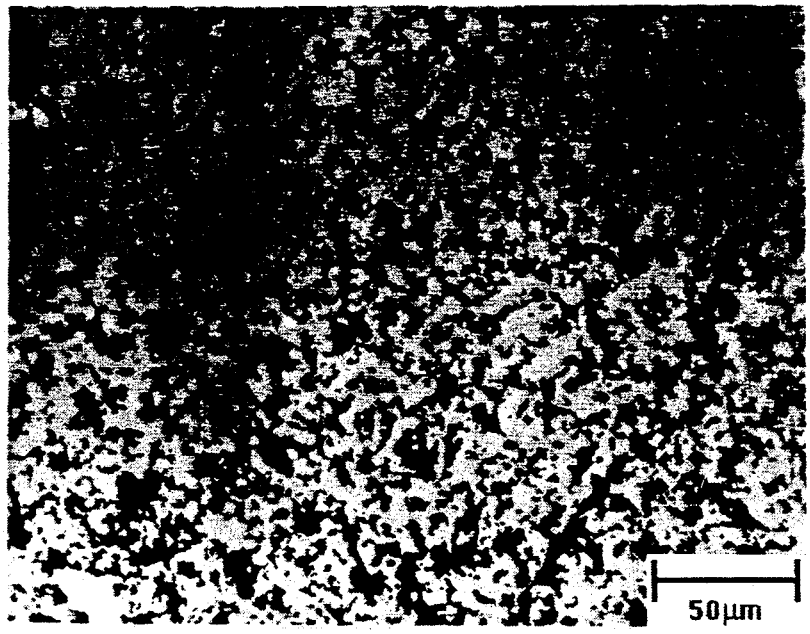
FIG. 10a PREPARED FROM 3μm Al
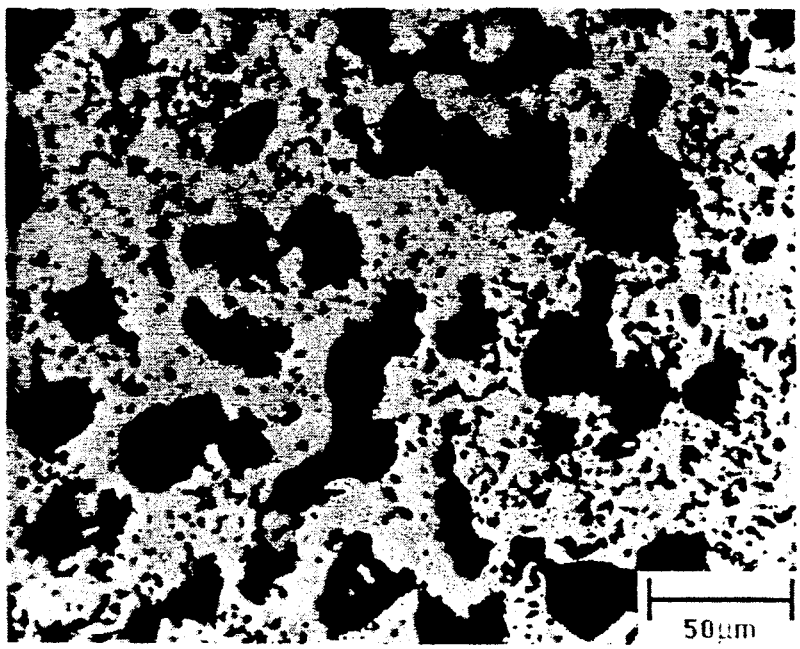
FIG. 10b PREPARED FROM 10μm Al

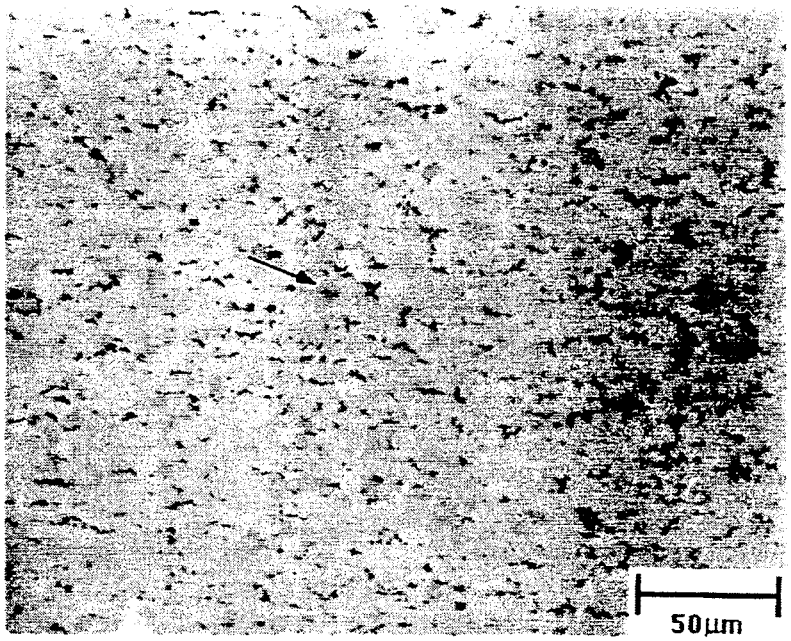
FIG. 12a AS-POLISHED
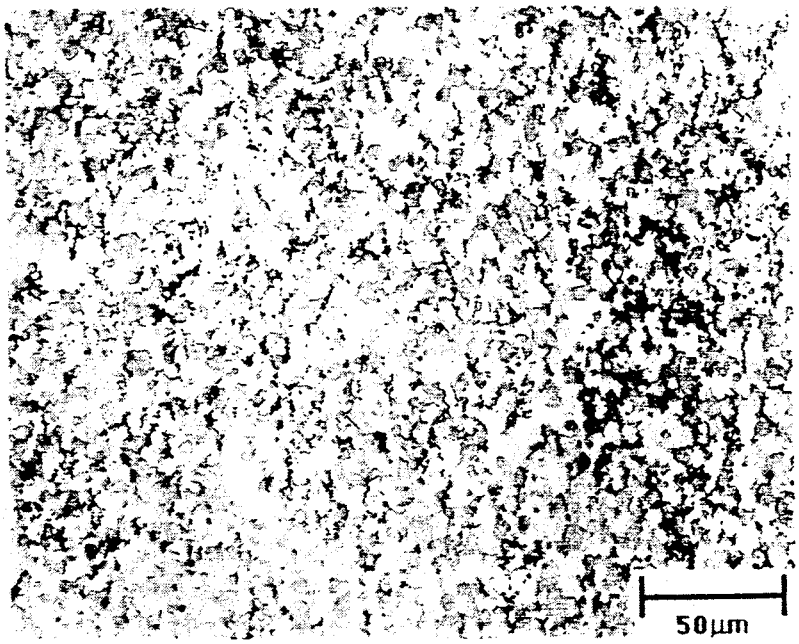
FIG. 12b ETCHED

PROCESS FOR SYNTHESIZING COMPOUNDS FROM ELEMENTAL POWDERS AND PRODUCT

CONTRACTUAL ORIGIN OF THE INVENTION

The United States Government has rights in this invention pursuant to Contract No. DE-AC07-76ID01570 between the United States Department of Energy and the EG&G Idaho, Inc.

FIELD OF THE INVENTION

This invention relates to powder metallurgy and, more particularly, to a novel process for synthesizing intermetallic compounds, such as iron aluminides, from elemental powders.

BACKGROUND OF THE INVENTION

In general, intermetallic parts may be formed by powder metallurgy and exhibit improved structural or performance characteristics over parts formed of other materials or compounds. Iron aluminides based on $Fe_3Al$ and FeAl, for instance, are suitable for use in a variety of structural applications and for a variety of components. The combination of low density, excellent oxidation and sulfidation resistance, and lack of strategic alloying elements makes these alloys particularly attractive. A variety of fabrication methods have been employed in the study of intermetallic compounds, and powder metallurgy processing is becoming increasingly important for obtaining desirable microstructures, improved properties, and near net shape manufacturing capabilities.

Most powder processing routes for intermetallics utilize rapidly solidified pre-alloyed powders or ribbons as starting materials, and consolidation is carried out by hot isostatic pressing or hot extrusion. Although quite successful, these methods involve many processing steps and considerable expense. High costs may be justified for certain applications by improvements in performance, however, many potential uses for these materials will be realized only if lower cost processing methods emerge.

An alternative powder processing method applicable to intermetallic compounds has received recent attention. This approach, known as reaction sintering, combustion systhesis, or self-propagating high-temperature synthesis, utilizes an exothermic reaction between powder constituents to synthesize compounds. Process advantages include the use of inexpensive and easily compacted elemental powders, low processing temperatures, short processing times, and considerable flexibility in terms of compositional and microstructural control. Depending upon thermodynamic properties and phase diagram features, a variety of reaction products are possible, ranging from highly porous to fully densified cast materials. Recent studies have demonstrated the success of this approach for fabricating nickel aluminides. Near full density $Ni_3Al$ alloys were achieved by pressureless reaction sintering of elemental powder mixtures. It was shown that sintering was controlled by the transient liquid phase that formed during rapid exothermic heating.

Elemental iron-aluminum mixtures represent a particular challenge for powder processing because extensive compact swelling has been observed. FIG. 1 shows the iron-aluminum phase diagram. Swelling is predicted based upon phase diagram features, notably, there is a large solubility for aluminum in iron, low reverse solubility, and a large melting point difference suggesting imbalanced diffusion rates. Systems that exhibit a large driving force for compound formation are particularly susceptible to the formation of porosity during alloying. The amount of swelling observed in such systems depends upon a number of processing variables including composition, particle sizes, heating rate, green density, and temperature.

The intent of prior studies on Fe-Al was not to form intermetallic compounds as products, nevertheless, the observations reported emphasize the problems encountered in this system. Compacts containing up to 6% Al have been studied. In general, poor sintering and compact distortion were caused by exothermic compound formation and outward diffusion of aluminum. Other mixtures containing up to 15% Al have also been studied. Expansion during heating caused by outward diffusion of aluminum and pore formation at prior aluminum particle sites have been observed. Intermetallic compounds were detected in ring-shaped regions surrounding aluminum particles. Swelling was observed to increase with aluminum content above 2.5% Al. Minimum dimensional change was obtained using pre-alloyed aluminum additions, rapid heating, and isothermal sintering temperatures over 1050° C.

An object of the present invention is to fabricate iron aluminides from elemental powders that overcome the aforementioned prior art problems.

SUMMARY OF THE INVENTION

In accordance with the present invention, a process of synthesizing an intermetallic compound from elemental powders is provided. The process, in general, comprises the steps of:

combining elemental powders in a ratio which approximates the stoichiometric composition of a compound;

heating the powders to initiate an exothermic reaction to form the compound; and controlling the reaction conditions including pressure and temperature during heating such that the compound has a desired chemical composition and density.

In an illustrative embodiment of the invention, powders of elemental Fe and Al are combined in ratios approximating the stoichiometric composition of $Fe_3Al$ and FeAl. In accordance with the invention, the elemental powders are heated under pressureless or hot pressing conditions to achieve a desired end product density. Additionally, processing variables including powder particle size, green density, and heating rate may be determined in accordance with the invention to achieve desired characteristics of the end product.

Other objects, advantages, and capabilities of the present invention will become more apparent as the description proceeds.

BRIEF DESCRIPTION OF THE DRAWINGS

FIG. 2 is a scanning electron micrograph of (*2a*) iron and (*2b*) aluminum (10 μm) powders used in an illustrative embodiment of the invention;

FIG. 5 is a comparative chart showing x-ray diffraction obtained during various steps of the process of the invention including: (5*a*) mixture of starting powders, (5*b*) reaction hot pressed Fe-15.8 Al, and (5*c*) reaction hot pressed Fe-32 Al;

FIG. 10 is comparative optical micrographs of pressureless sintered Fe-15.8 Al prepared from (10*a*) 3 μm Al and (10*b*) 30 μm Al, at a heating rate of 10° C./min in accordance with the invention;

FIG. 12 is comparative optical micrographs of reaction hot pressed Fe-15.8 Al formed in accordance with the invention in the (12*a*) as-polished condition and (12*b*) etched, with the dark phase being porosity and the ternary carbide $AlFe_3C_{.5}$ identified by arrow.

DETAILED DESCRIPTION OF THE INVENTION

Figure 1:
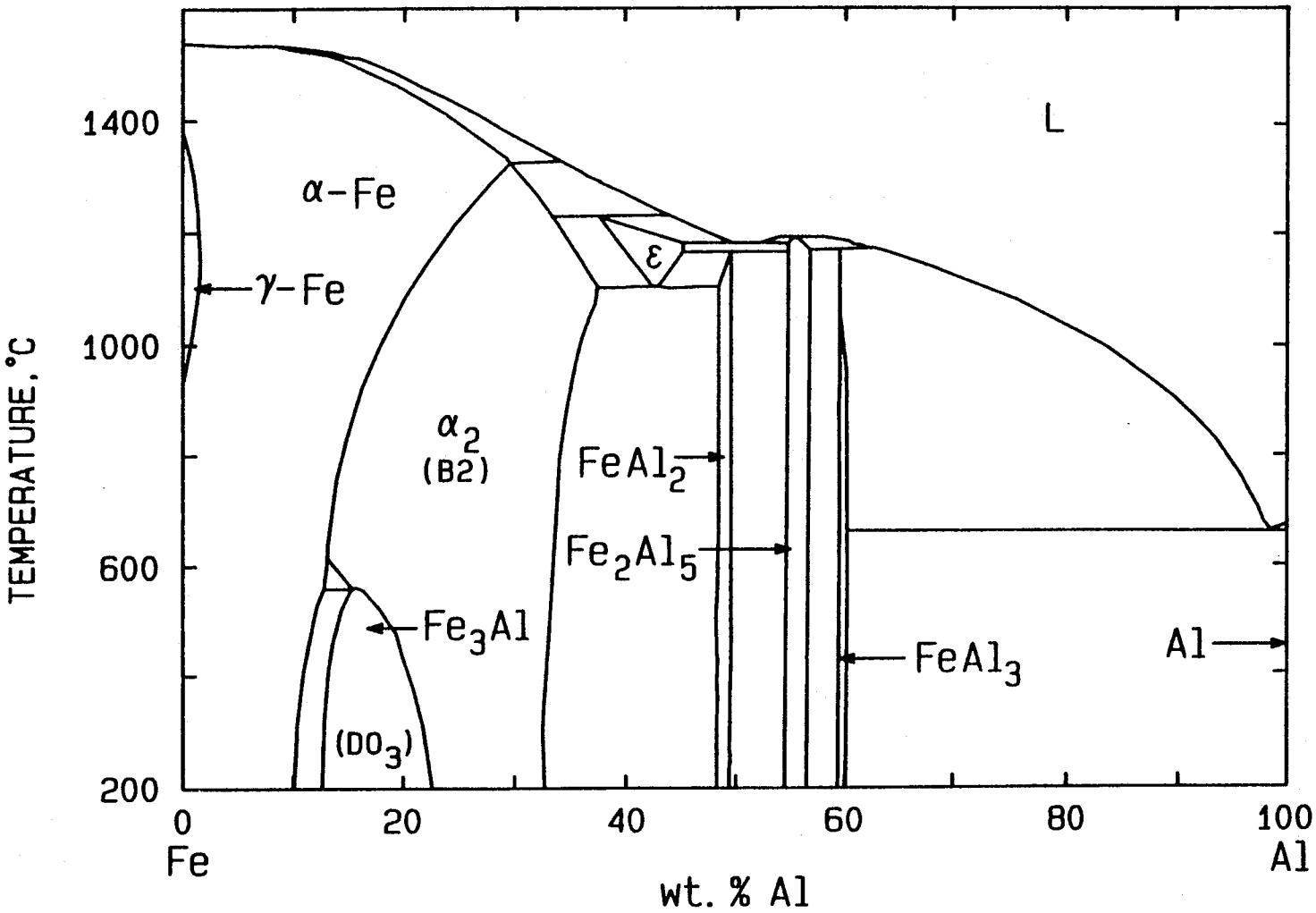
FIG. 1 is an iron-aluminum phase diagram.

In general, the present invention is directed to a process for forming a compound from powder elements in which the elements are first combined in a stoichiometric ratio and then heat treated to initiate an exothermic reaction to form the compound. The reactant elements and the physical characteristics of the reactant elements (i.e., particle size, green density, temperature) can be selected in accordance with the invention to effect a desired end product. In addition, process variables during heat treatment including temperature, pressure, and heating rate can be closely controlled in accordance with the invention to achieve desired characteristics of the end product compound. Heat treatment can be carried out under conditions of pressureless sintering or hot pressing to achieve a desired densification of the end product.

In a preferred form of the invention, elemental Fe and elemental Al are processed to form $Fe_3Al$ and FeAl compounds. It is to be understood, however, that the process of the invention can be utilized to form other compounds from other elements.

The main steps of the invention can be simply stated as mixing and heat treating elemental powders under controlled conditions of temperature and pressure to produce an exothermic reaction to form an end product compound with desired properties. A desired densification may be achieved by sintering in a vacuum or by pressure assisted densification by heating during compression. An extremely porous or a fully densified end product can thus be achieved as required.

As a first step in the process of the invention, elemental powders are combined in a desired stoichiometric ratio. Elemental Fe and Al can be combined, for instance, in an Fe-15.8 wt.% Al (~28 at.% Al) ratio to produce $Fe_3Al$. Alternately, elemental Fe and Al can be combined in an Fe-32 wt.% Al (~50 at.% Al) ratio to produce FeAl. Powder batches of the elements may be combined by techniques which are known in the art such as dry mixing in a mixer. Additionally, particle size of the elemental powders (ex 3 to 30 μm) as well as the green density (ex 53 to 71 %) of the powders may be selected for varying the characteristics of the end product compound.

After the elemental powders have been mixed, a compact is formed and the heat treatment or sintering is initiated. During heat treatment, the compact is heated to a temperature high enough to initiate an exothermic reaction. For an Fe-Al composition, as previously described, this temperature is above the melting point of Fe-Al and typically in the range of from about 600 to 650.C. Heating may continue in the range of, for example, 1000.C without the requirement of an isothermal hold.

The heat treatment may be accomplished in a vacuum (pressureless sintering) or under pressure by applying a load to the mixed compact during the exothermic reaction (hot processing). A desired densification of the final compound can thus be achieved.

Thermal analysis techniques and microstructural observations have been used by the inventors to analyze and understand the reaction mechanisms and for selecting the appropriate process variables. Alloys fabricated in accordance with the invention can be formed with near theoretical full density for hot pressing and near 75% of full density for pressureless sintering.

EXPERIMENT

Fe-Al Embodiment

The characteristics of the powders used in these experiments are listed in Table I.

TABLE I

Characteristics of the iron and aluminum powders used in this study.

| CHARACTERISTIC | IRON | ALUMINUM |
|---|---|---|
| vendor | GAF | Valimet |
| designation | CIP-R-1510 | H-3, H-10, H-30 |
| powder type | carbonyl | gas atomized |
| mean particle size, μm | 6-9 | 3, 10, 30 |
| apparent density, g/cm³ | 2.7 | — |
| tap density, g/cm³ | 3.5 | 1.5 |
| purity, % | 99.5 | 97.5-99.0 |
| majority impurities, ppm | C = 750 max<br>N = 500 max<br>O = 500 max | Fe = 2000<br>volatiles = 1000 |

The iron powder, a reduced variety manufactured by thermal decomposition of iron carbonyl, had a mean particle size of about 8 μm. The aluminum powder was produced by helium atomization and was obtained in several particle sizes. Both powders exhibit a highly spherical morphology as shown in FIG. 2.

Two compositions were studied, Fe-15.8 wt.% Al (~28 at.% Al) and Fe-32 wt.% Al (~50 at.% Al) under pressureless sintering and hot pressing conditions. The powder batches were prepared by dry mixing in a turbula mixer for 1 hour. For pressureless sintering, 13 mm diameter compacts were prepared by compaction at pressures from 70 to 280 MPa. Zinc stearate was used as a die wall lubricant. For hot pressing experiments, the powders were loaded into a graphite die and pressures from 10 to 70 MPa were applied and maintained during heating. Pressureless sintering experiments were carried out in a horizontal tube furnace under a vacuum of $1.3\times10^{-3}$ Pa. The sintering treatment consisted of heating the compacts through the temperature required to initiate the exothermic reaction, typically in the range of 600° to 650° C. After reaching a maximum furnace temperature of 1000° C., the power was turned off; no isothermal hold was employed. Hot pressing experiments involved heating in a graphite resistance furnace to 400° C. under a vacuum of 4 Pa, then heating to 1000° C. at 20° C./min under flowing argon. After sintering or hot pressing, densities were measured using the water immersion method (ASTM Standard B328-73).

Processing variables examined included aluminum particle size (3 to 30 μm), green density (53 to 71 percent of theoretical), and heating rate (10° to 50° C./min). Results are reported as sintered density and densification. Densification D is defined as the relative change in density during sintering compared to the maximum possible density change, $$D = \frac{\rho_s - \rho_g}{\rho_t - \rho_g}$$

where $\rho_s$ is the sintered density, $\rho_g$ is the green density, and $\rho_t$ is the theoretical density. This parameter is useful for comparing sintering behavior because it takes into account differences in the green and theoretical densities resulting from processing and compositional variations. The theoretical densities were taken to be 6.7 g/cm$^3$ and 5.6 g/cm$^3$ for the $Fe_3Al$ and FeAl compositions, respectively.

A variety of techniques were used in order to understand the reaction mechanisms and microstructural development in Fe-Al compacts. These included differential thermal analysis (DTA), scanning electron microscopy (SEM), and x-ray diffraction. For optical metallography, samples were mounted, polished, and examined in the unetched and etched conditions. Additional experiments were conducted in which a hole was drilled into the powder compact, and a type K thermocouple (0.13 mm diameter wires) was inserted to allow measurement of the compact temperature during reaction. In another series of experiments, cylindrical powder compacts approximately 10 cm in length were suspended in a vertical tube furnace such that only one end of the sample was within the hot zone. When the exothermic reaction was initiated at the hot end, the sample was quenched into water. This allowed the propagating reaction front to be stopped and provided an opportunity to examine the details of the reaction process.

A preliminary assessment of mechanical properties involved room temperature tensile testing using miniature flat dogbone specimens. The overall specimen length was approximately 36 mm, the thickness was approximately 2 mm, and the gauge length was 18 mm. When fracture occurred outside of the gauge section, the overall specimen length was used to calculate failure elongation.

RESULTS

Reaction Behavior

Figure 3:
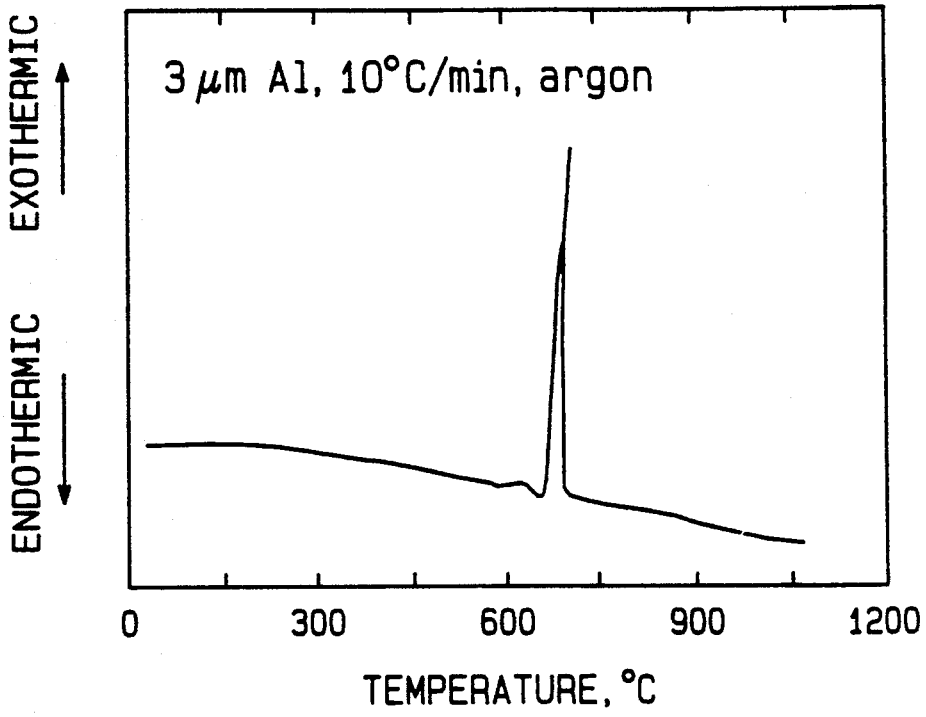
FIG. 3 is a graph illustrating a differential thermal analysis (DTA) scan taken during the process of the invention on loose powder of Fe-15.8 Al.
Figure 4:
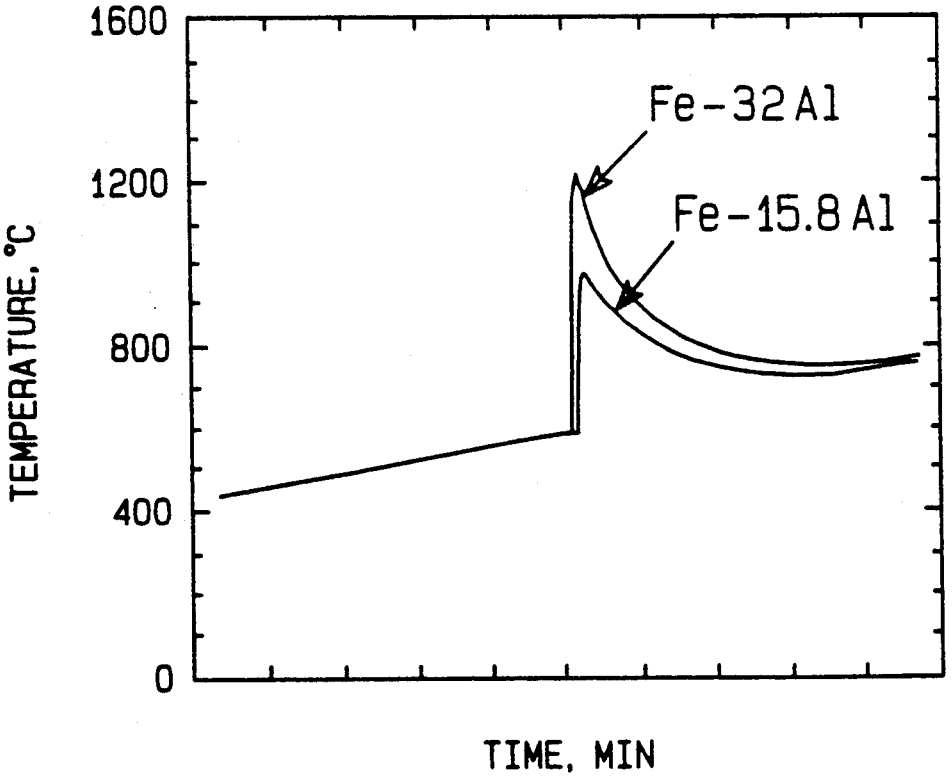
FIG. 4 is a temperature-versus-time graph for furnace heated Fe-15.8 Al and Fe-32 Al measured using thermocouples embedded in materials processed in accordance with the invention.
Figure 6A:
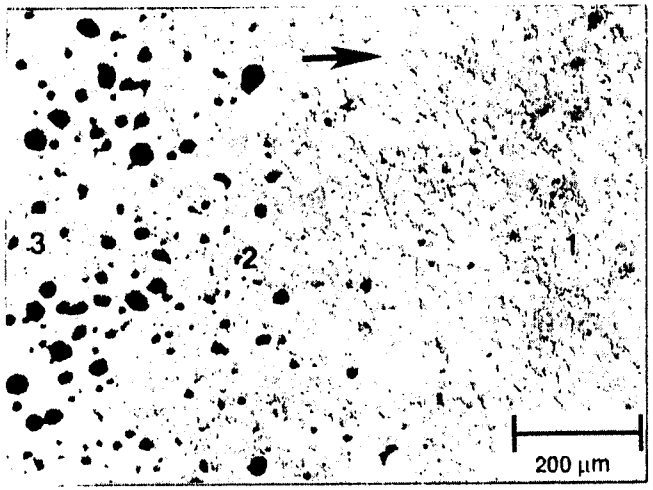
FIG. 6 shows optical micrographs taken at different locations on a sample formed in accordance with the invention showing: (6*a*) quenched reaction zone in Fe-15.8 Al, (6*b*) the leading edge of the front (region 1), (6*c*) center of the reaction zone (region 2), and (6*d*) the trailing edge of the front (region 3)
Figure 6B:
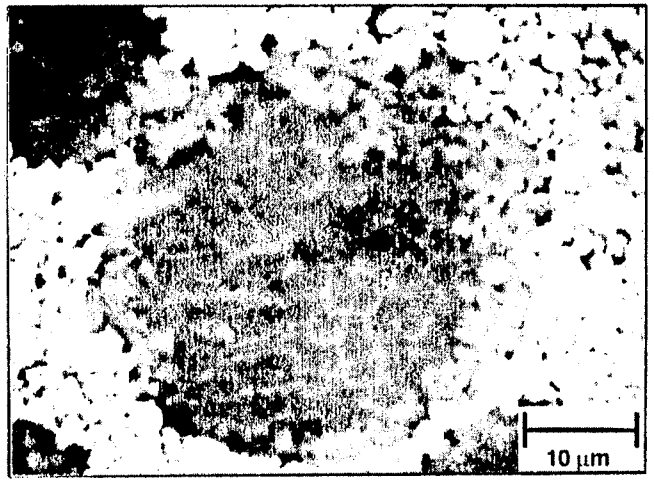
Figure 6C:
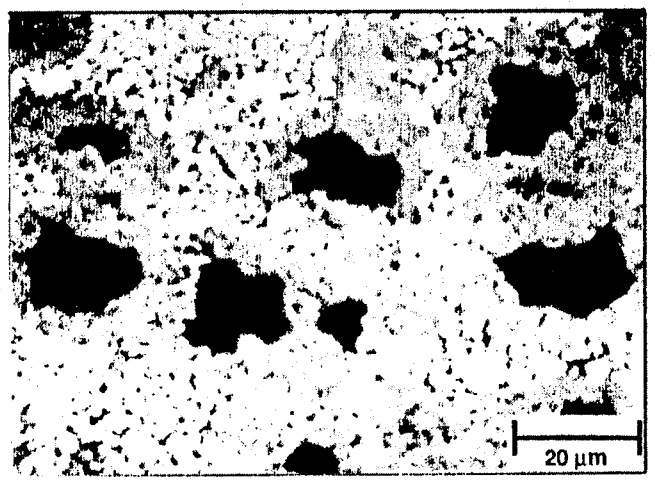
Figure 6D:
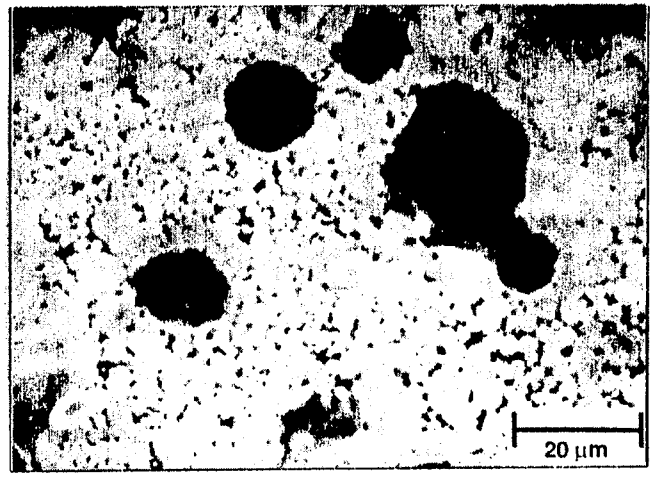

During heating of the iron-aluminum powder mixtures, a strong exothermic reaction was observed near the melting point of aluminum. This is demonstrated in FIG. 3, which shows a DTA scan performed on loose powder of Fe-15.8 Al. Typically, a small exothermic peak was noted just prior to the predominant peak that marked the strong reaction. The temperature corresponding to the onset of the first peak was always below the lowest eutectic temperature of 652.C, and was dependent upon processing variables; smaller aluminum particle sizes and slower heating rates gave a lower onset temperature. Temperature profiles measured by thermocouples embedded in 13 mm diameter compacts are shown in FIG. 4. During reaction, the compact temperatures were observed to rise rapidly, reading a maximum temperature within 2 s after initiation. After maintaining the maximum temperature for approximately 5 s, the compacts cooled to the furnace temperature within approximately 3 minutes. The maximum reaction temperatures, reproducible to within ±20° C., were measured to be 980° C. and 1220° C. for the Fe-15.8 Al and Fe-32 Al compositions, respectively.

FIG. 5 shows x-ray diffraction results for the starting Fe-15.8 Al powder mixture, and for the Fe-15.8 Al and Fe-32 Al mixtures after exothermic reaction in the hot press. Both materials appear to have undergone complete reaction, as evidenced by the shift in position of the iron fundamental peaks, and the absence of the Al(111) peak. Peaks corresponding to the $DO_3$ and the B2 ordered structures were identified. The Fe-15.8 Al material contains both types of order; long range order parameters S were calculated to be 0.30 and 0.28 for the $DO_3$ and B2 structures, respectively. The additional peaks observed in the Fe-15.8 Al material were identified as the ternary carbide $AlFe_3C_{.5}$. The Fe-32 Al material exhibits only B2 order, as expected from the phase diagram, with an order parameter S of 0.75.

Chemical analysis was performed on the Fe-15.8 Al material and the results are listed in Table II.

TABLE II

Chemical analysis results for reaction hot pressed Fe-15.8 Al.

| element | Fe | Al | C | $O_2$ | $N_2$ | Si | S | P |
|---|---|---|---|---|---|---|---|---|
| wt. % | 84.88 | 14.97 | 0.12 | 0.23 | 0.004 | 0.011 | 0.0001 | 0.014 |

The high oxygen content can primarily be attributed to surface oxides associated with the fine aluminum powder. The high carbon content was originally thought to originate from the graphite hot pressing die; however, the same carbon content was measured in material that was pressureless sintered in vacuum. It was, therefore, concluded that this level of carbon was present in the starting iron powder, even though the measured levels are higher than the maximum reported by the manufacturer (Table I). Thus, the carbon content of the carbonyl iron powder was responsible for the formation of $AF_3C_{.5}$ in the Fe-15.8 Al samples. The reason for the formation of $AlFe_3C_{.5}$ in Fe-15.8 Al, and not in Fe-32 Al, is unclear at this time.

Observations of the reaction sequence were made on samples in which the propagating reaction front was stopped by a water quench. A low magnification optical micrograph of a quenched reaction zone, and higher magnification SEM micrographs highlighting the reaction sequence, are shown in FIG. 6 for a Fe-15.8 Al sample. At the leading edge of the reaction front there was evidence that an eutectic liquid existed within the sites occupied by original aluminum particles, and dissolution of the surrounding iron particles has begun. The center of the reaction zone was characterized by large pores at the prior aluminum particle sites surrounded by an aluminum rich phase that appears to have been at least partially liquid prior to the quench. Pure Fe particles were still present far from the aluminum rich regions. Electron microprobe analysis gave the approximate composition of the dark phase as 58 wt.% Al. According to the phase diagram, this composition is close to either the $FeAl_3$ or $Fe_2Al_5$ compound. Toward the trailing edge of the front, further homogenization was observed. At least two compounds were seen surrounding the pores; however, these layers were too thin to obtain reliable compositional information using the microprobe. Clear evidence of localized densification due to the presence of a liquid was present in these regions. Behind the reaction front (not shown), greater homogenization and additional localized sintering were observed; however, even several millimeters away from the reaction zone complete homogenization was not found. In contrast, samples sintered by furnace heating were examined using x-ray mapping in the SEM, and it was shown that chemically homogeneous microstructures were obtained. Observations were also made on quenched samples of Fe-32 Al and similar microstructural features were found. The width of the reaction zone was considerably larger in this case.

Pressureless Sintering

Figures 7A, 7B:
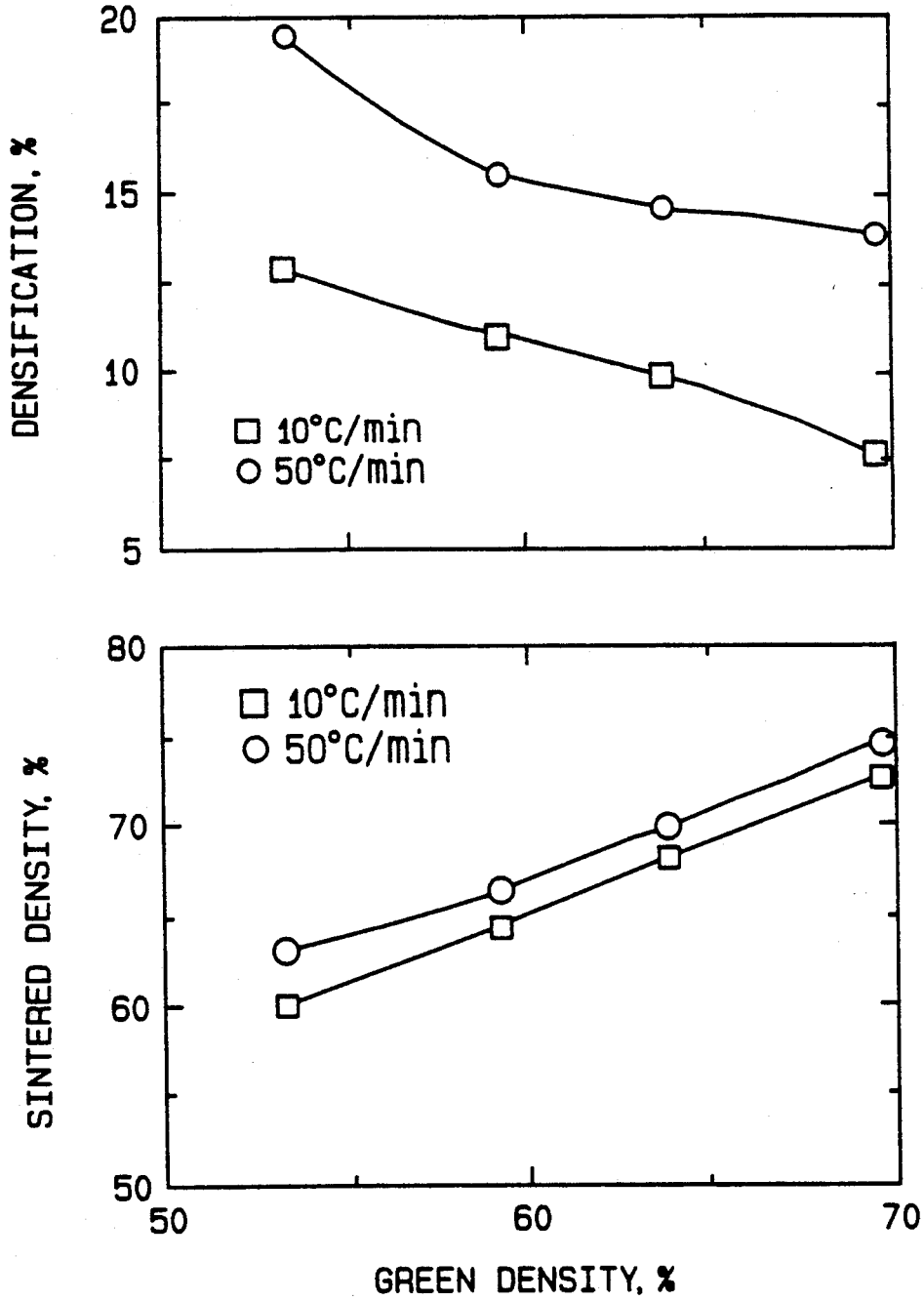
FIGS. 7*a* and 7*b* are comparative graphs showing densification and sintered density for pressureless sintered Fe-15.8 Al compacts formed in accordance with the invention shown as a function of green density for two heating rates, and with an aluminum particle size of 3 μm.
Figures 8A, 8B:
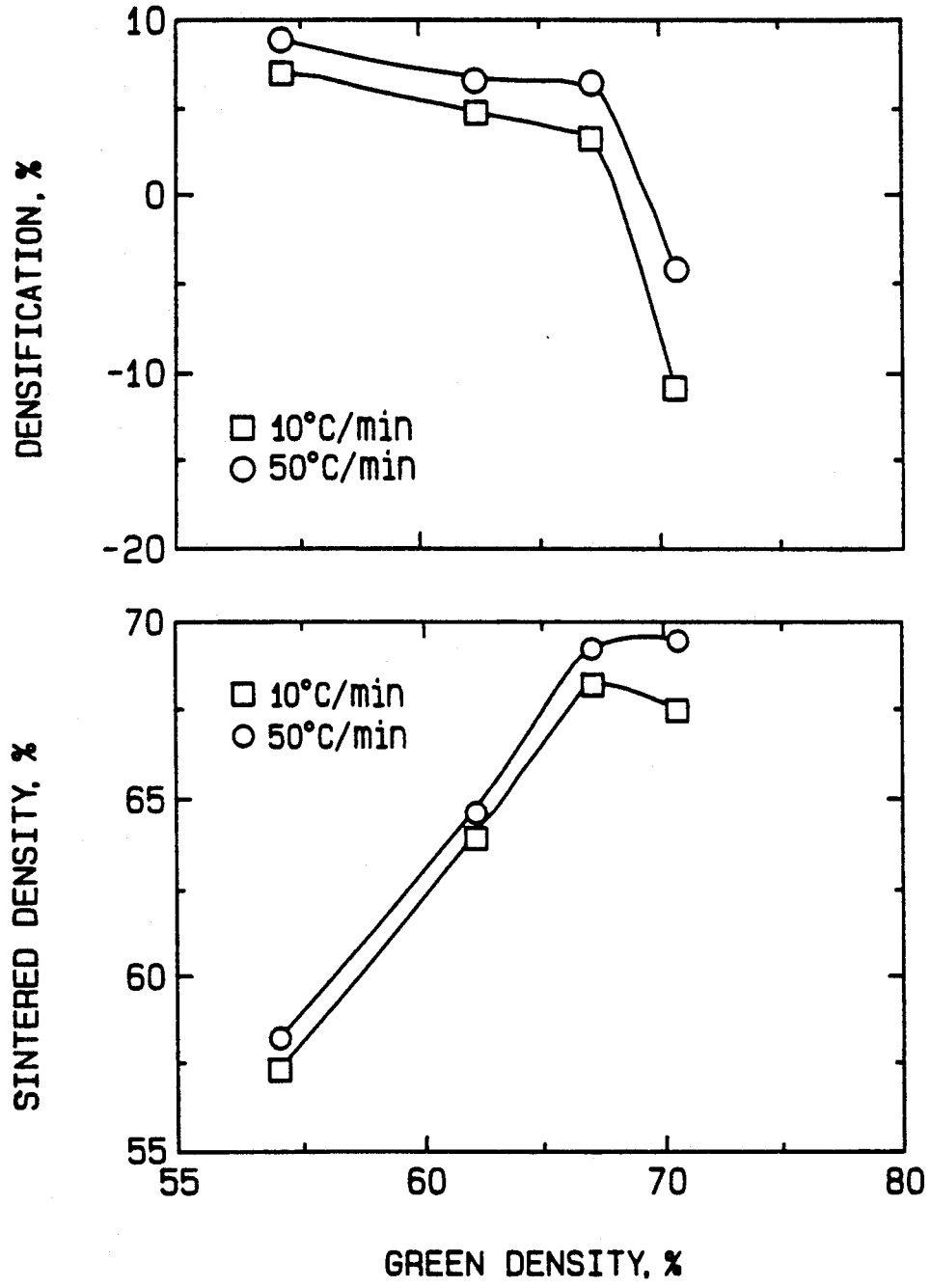
FIGS. 8*a* and 8*b* are comparative graphs showing densification and sintered density for pressureless sintered Fe-32 Al compacts formed in accordance with the invention shown as a function of green density for two heating rates with an aluminum particle size of 3 μm.

Sintering behavior showed considerable dependence on processing variables. FIGS. 7 and 8 show the densification and sintered density results for the Fe-15.8 Al and Fe-32 Al compositions, respectively, for various green densities and heating rates. These experiments were carried out using 3 μm Al powder. For both compositions, densification decreased and sintered density increased with higher green densities. Furthermore, faster heating rates resulted in greater densification and higher sintered densities. For Fe-15.8 Al compacts, densification was observed in all cases; however, for Fe-32 Al compacts, swelling was observed for the highest green density. In general, greater densification and higher sintered densities were achieved with the Fe-15.8 Al compacts. The highest sintered densities obtained were approximately 75 percent of theoretical for Fe-15.8 Al, and 69 percent for theoretical for Fe-32 Al.

Figures 9A, 9B:
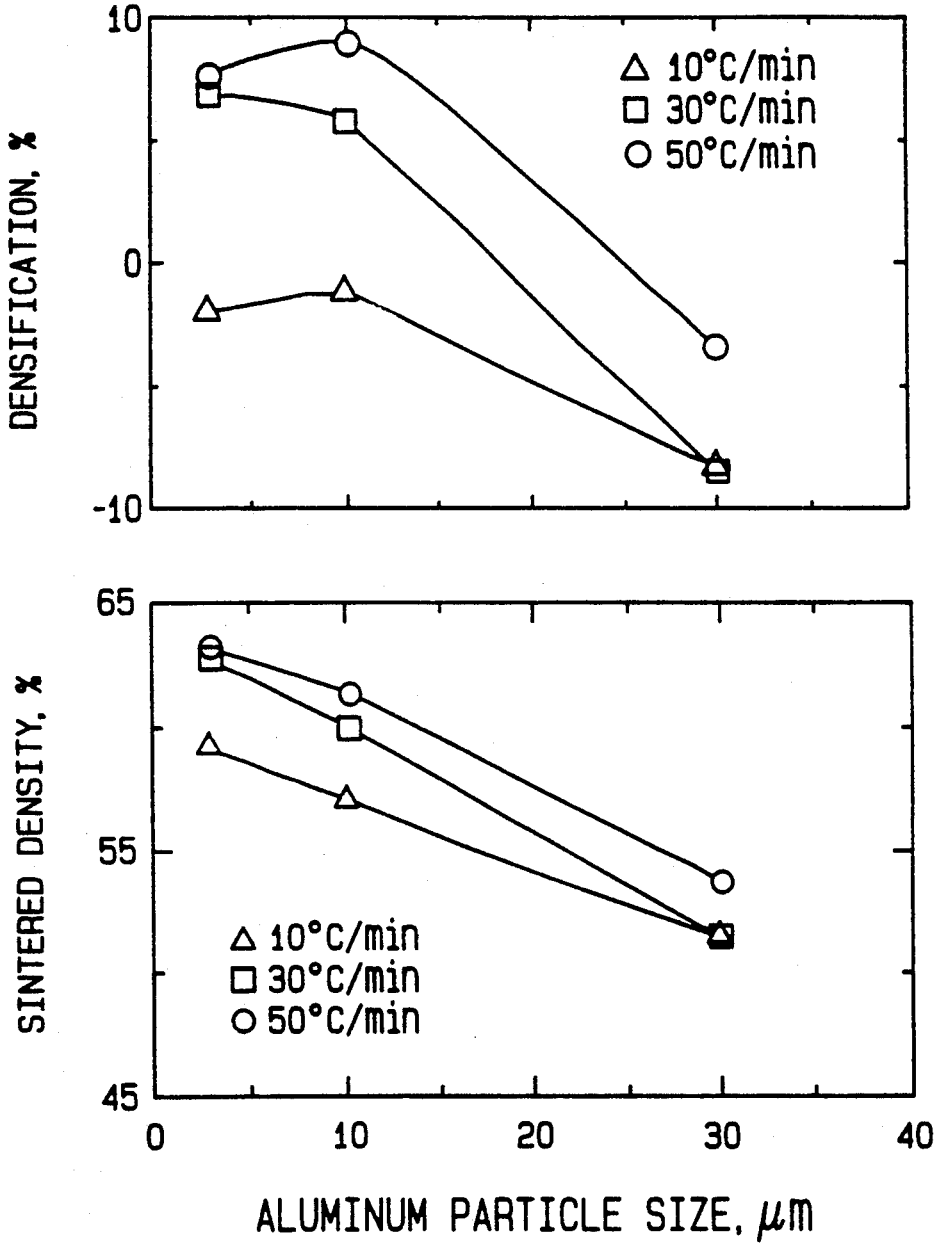
FIGS. 9*a* and 9*b* are comparative graphs showing densification and sintered density for pressureless sintered Fe-15.8 Al compacts formed in accordance with the invention shown as a function of aluminum particle size and heating rate.

The effect of aluminum particle size on densification and sintered density is shown in FIG. 9 for Fe-15.8 Al compacts sintered at three heating rates. Sintered density decreased continuously with increasing particle size. Densification remained approximately constant for the 3 μm and the 10 μm particle size, but decreased dramatically when 30 μm aluminum powder was used. In all cases, faster heating rate resulted in improved densification and higher sintered densities. The aluminum particle size had a significant effect on the size and distribution of porosity in the sintered material. FIG. 10 compares optical micrographs of samples produced using 3 μm and 30 μm aluminum, at a heating rate of 10° C./min. The 3 μm aluminum sample shows a relatively uniform distribution of porosity, whereas the 30 μm aluminum sample shows a bimodal porosity distribution with the larger pores corresponding approximately to the size of the original aluminum particles.

Hot Pressing

Figure 11A:
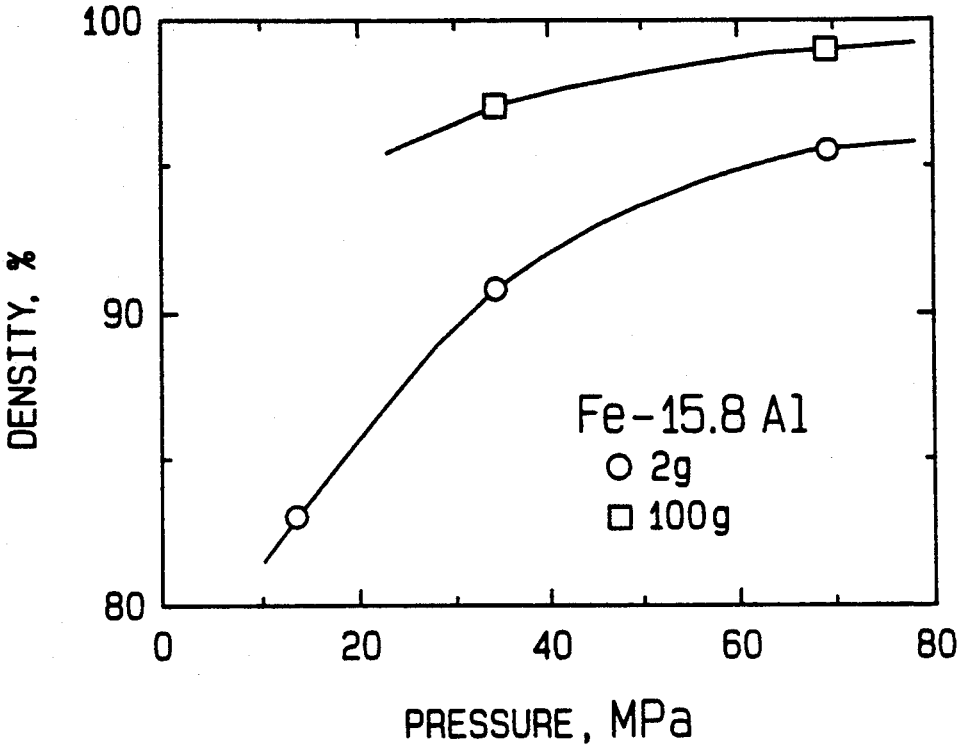
FIG. 11 is comparative graphs showing density as a function of applied pressure for reaction hot pressing powders of (11*a*) Fe-15.8 Al and (11*b*) Fe-32 Al in accordance with the invention, with an aluminum particle size of 3 μm.
Figure 11B:
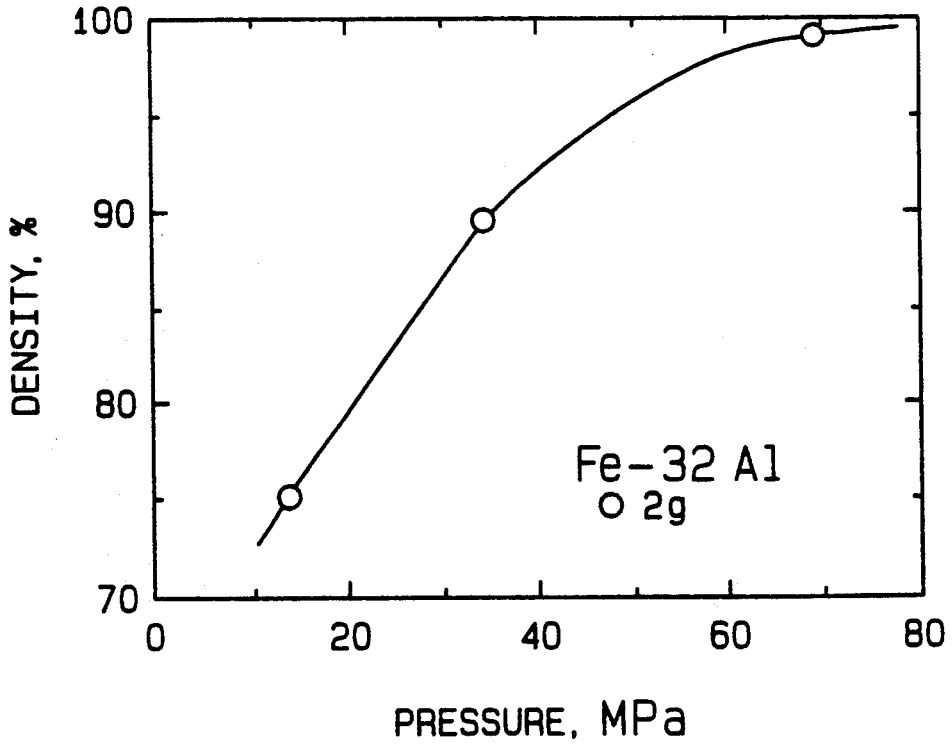

Pressure assisted densification was carried out by applying a load to the samples during the exothermic reaction. The effect of applied pressure on density is shown in FIG. 11 for both the Fe-15.8 Al and Fe-32 Al composition. Note that near full density was achieved for both compositions when an applied pressure of 70 MPa was used. For the Fe-15.8 Al experiments, two sizes of compacts were examined, 12 mm diameter (approximately 2 g of powder) and 50 mm diameter (approximately 100 g of powder). Significantly higher densities were obtained for a given applied pressure when the larger powder charge was used. This suggests that the larger thermal mass resulted in slower cooling from the reaction temperature, thus allowing more densification to take place.

Optical micrographs of the near full density reaction hot pressed Fe-15.8 Al material are shown in FIG. 12. In the as-polished condition, a fine distribution of porosity (approximately 2 vol.%) is evident, along with a small amount of the second phase identified by x-ray diffraction as $AlFe_3C_{.5}$. The grain structure is evident in the etched condition. An equiaxed grain morphology was observed with a mean grain size estimated to be about 6 to 9 μm. The porosity distribution and grain size of the Fe-32 Al material were similar to those observed for Fe-15.8 Al; however, no second phase was found.

Compound Formation

It has been established in prior studies that during heating of iron-aluminum powder compacts interdiffusion occurs by the preferential outward flux of aluminum, leading to the formation of pores at the prior aluminum particle sites. The imbalanced mass flux (i.e. Kirkendall effect) results from the solubility relationship indicated by the phase diagram, and the fact that the diffusion coefficient of aluminum in iron is greater than that of iron in aluminum or the intermediate compounds. Analysis of samples quenched from below the reaction initiation temperature confirmed the existence of an aluminum rich compound formed in the solid state, probably FeAl, surrounding the aluminum particles. Finer aluminum particle sizes and slower heating rates promote more solid state interdiffusion, resulting in initial compound formation at lower temperatures, as confirmed by the DTA results.

A liquid phase forms within the compact when the lowest eutectic temperature is reached. Solid state growth of compounds at interparticle contacts caused localized heating and is responsible for initial liquid formation before the furnace reaches the eutectic temperature. Once a small quantity was formed, the aluminum rich liquid caused a rapid increase in the reaction rate. As the temperature of the compact rises, more liquid is formed, there is a further increase in the reaction rate, and spontaneous combustion of the powder compact is observed. The speed of the overall process suggests that final compounds form directly from the liquid phase. The combustion process is, therefore, characterized by melt formation and spreading, accompanied by exothermic heating due to chemical mixing. Microstructural observations from the quenched reaction zone suggests that this process takes place by a dissolution and reprecipitation mechanism as the liquid front advances outward from the original aluminum particle sites. This hypothesis is supported by the peak temperature measurements in furnace heated specimens which confirmed that the melting points of the product phases were not exceeded during the reaction. Due to preheating, reaction temperatures measured in furnace heated compacts are expected to exceed those achieved in the propagation experiments; this explains the greater degree of homogenization and sintering achieved in these specimens. Further homogenization may also have been caused by continued heating above the reaction temperature.

Reaction temperature measurements can be used to calculate the enthalpy change associated with compound formation. Consider the reaction between Fe and Al to produce the compound $Fe_3Al$ as follows:

$$3Fe + Al \rightarrow Fe_3Al$$

If the reaction occurs at the initiation temperature $T_i$, the standard enthalpy change $\Delta H^\circ$ can be expressed as:

$$\Delta H^0 = \Delta H_f^0(T_i) + \int_{T_i}^{T_{max}} C_p(p)dT$$

where $\Delta H_f^\circ(T_i)$ is the heat of formation of the compound at the initiation temperature, $C_p(p)$ is the heat capacity of the product, $T_{max}$ is the maximum reaction temperature achieved by the product. Because the heating rate is high and the reaction time short, it is reasonable to assume adiabatic conditions, i.e. $\Delta H^\circ = 0$. Equation 2 then becomes:

$$-\Delta H_f^0(T_i) = \int_{T_i}^{T_{max}} C_p(p)dT$$

Provided that $C_p(p)$ is known, the heat of formation of the compound at 298 K, $\Delta H_f^\circ(298,)$, can be estimated using available heat capacity data for the elemental reactants. In the absence of actual data for $C_p(p)$, and considering the fact that high temperature heat capacities are similar for most metals, a reasonable estimate was to use the heat capacity of pure Fe for that of the aluminides. The results of these calculations gave values of $\Delta H_f^\circ(298)$, to be $-18$ kJ/mol and $-31.8$ kJ/mol for the $Fe_3Al$ and FeAl compounds, respectively. These values are in excellent agreement with semi-empirical theoretical predictions. In light of the fact that some mixing occurs in the solid state prior to the exothermic reaction, and that partially ordered compounds were obtained, these values should be considered as apparent enthalpies of formation.

Densification Behavior

The reaction mechanism suggests that densification involves a special case of transient liquid phase sintering (TLPS). In traditional TLPS, final densification is determined by the net result of compact growth during heating, and compact shrinkage during existence of the liquid. The swelling and shrinkage mechanisms generally exhibit considerable sensitivity to material characteristics and processing variables. Compact growth can be caused by an imbalanced mass flux during alloying or by liquid penetration along solid grain boundaries. Compact shrinkage is controlled by the quantity, distribution, and duration of the liquid phase. Further complexity arises during TLPS when liquid formation is accompanied by compound growth and rapid exothermic heating. Extensive pore formation is possible because the driving force for compound formation is several orders of magnitude larger than surface energy considerations. In the present experiments, it was demonstrated that the liquid duration is extremely short at any given location within the compact. Under these circumstances, localized shrinkage may occur by capillary induced rearrangement; however, solution-reprecipitation process cannot contribute significantly. Continued heating above the reaction temperature or isothermal holding at elevated temperature, therefore, provide little benefit for densification.

Since dimensional changes were not monitored continuously during these experiments, sequential growth and shrinkage processes were not observed directly. Thus, the effects of these events can only be inferred from the net densification results. FIGS. 7–9 demonstrate that, for both Fe-15.8 Al and Fe-32 Al compacts, greater densification and higher sintered densities were achieved with faster heating rates, irrespective of green density or aluminum particle size. Faster heating gives less solid state interdiffusion and less compact growth prior to reaction, and also provides more liquid during exothermic heating. Although higher aluminum concentrations were expected to give a greater quantity of liquid, it has been shown for swelling systems that the amount of swelling increases with the concentration of liquid forming additive. The fact that less densification was observed for Fe-32 Al compacts suggests a dominant role played by swelling during heating.

FIG. 9 shows the beneficial effect of fine aluminum particle sizes and faster heating on Fe-15.8 Al compacts. Swelling was observed when 30 μm aluminum was used, irrespective of heating rate, as well as for all aluminum particle sizes at the slowest heating rate. Even though use of smaller aluminum particle sizes promotes greater solid state interdiffusion prior to the reaction, it also give a more uniform, interconnected liquid distribution during the reaction. In this case, the importance of the liquid distribution outweighs the effects of swelling during heating. This result is emphasized in FIG. 10*b*, where the 30 μm aluminum caused the formation of large isolated pores that remained in the microstructure after sintering.

Swelling was always observed in the prior studies on Fe-Al for aluminum contents exceeding 2.5%. The fact that densification was achieved in the present study using higher aluminum concentrations can be explained by considering the effect of green density on densification. Higher green densities, known to promote swelling, were obtained in the prior investigations due to the better compactability of the coarse iron powders used. The fine iron powder used in this study could not be readily compacted to green densities exceeding 75% of theoretical; therefore, a lower tendency for swelling existed. Although sintered densities were not previously reported, the amount of swelling suggested that the final relative densities did not differ significantly from the current results. It is believed that higher sintered densities may be possible in this system by optimizing the tradeoff between iron particle size and green density. Unfortunately, iron particle sizes in the desirable 10–30 μm size range are not readily available.

It is interesting to compare the current results on Fe-Al with prior results obtained in the Ni-Al system, where reaction processing with similar particle sizes was capable of producing near full density alloys. It is believed that the lower relative densities for iron aluminides can be attributed, in part, to the smaller heats of formation for these compounds that result in lower peak temperatures during exothermic reaction. This is dramatically illustrated by the fact that heating a stoichiometric NiAl mixture results in complete melting of the compact and a cast structure. Secondly, aluminum diffuses faster in bcc iron than in fcc nickel; therefore, homogenization occurs more quickly. The shorter liquid duration provides less opportunity for shrinkage to take place.

Properties of Reaction Hot Pressed Materials

Room temperature tensile properties were measured in the as-fabricated condition and after heat treatment for the near full density $Fe_3Al$ hot pressed at 70 MPa. All specimens failed in a brittle manner; therefore, only fracture strength and elongation based on total sample length could be reliably measured. In the as-fabricated condition, an average strength of 840 MPa and elongation of 1.2% were obtained. Heat treatment for 24 h at 500° C. was performed to increase the amount of $DO_3$ order; this resulted in an average strength of 750 MPa and elongation of 1.2%. A B2 ordering heat treatment consisting of holding at 750° C. for 1 h followed by an oil quench resulted in one specimen with a strength of 900 MPa and an elongation of 3.1%, and another specimen with a strength of 710 MPa and 1% elongation. Fracture surface observations indicated that failure occurred predominately by intragranular cleavage.

The observed variability in properties for a given heat treatment was probably caused by the presence of residual porosity within the samples. Nevertheless, the fracture strength values were significantly higher than those reported for a wrought alloy of the same composition which had a grain size of 110 μm, a tensile strength of 514 MPa, and 3.7% elongation. These results can most likely be attributed to grain size effects; however, the presence of the $AlFe_3C_{.5}$ second phase may contribute to strengthening and reduced ductility. It is expected that improved ductility can be achieved in reaction processed $Fe_3Al$ through elimination of the remaining 1–2% porosity, and by alloying with Cr. Properties were not measured for the stoichiometric FeAl material, although brittleness was observed; most studies on FeAl focus on compositions near Fe-40 at.% Al.

Addition of Alloying Elements

It is also possible to add alloying elements to the powder mixtures for the purpose of achieving desired effects on the microstructure or properties of the compounds. For example, it has been shown in prior art that Cr additions to $Fe_3Al$ improve room temperature ductility. In our experiments, Cr elemental powder was added to the Fe-15.8 wt.% Al mixtures in the amounts of 2 and 5 wt.%. During the reaction to form the compound, the alloying elements are incorporated into the material resulting in a more or less homogeneous alloy. Other alloying elements could also be added, if desired, to produce complex alloys with improved properties.

Hot Isostatic Press

Figure 13:
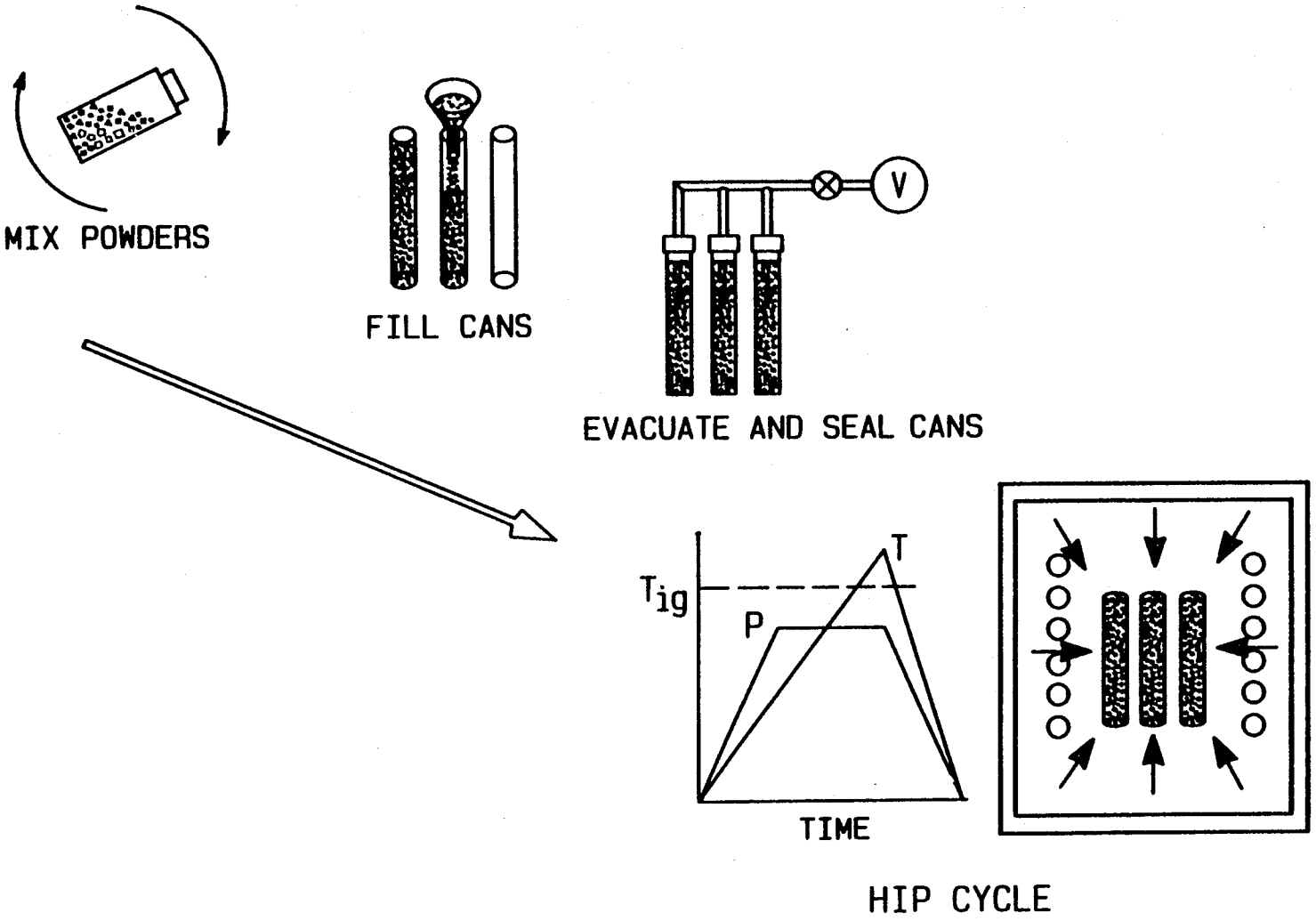
FIG. 13 is a schematic showing formation of a compound in accordance with the invention with the use of a hot isostatic press.

A hot isostatic press (HIP) may also be utilized to apply external pressure to the powder compact during the exothermic reaction. A schematic diagram of the process is shown in FIG. 13. After mixing, the powder can either be loaded into the HIP container (typically Ni tubing) by pouring, as shown in the drawing (FIG. 13) or, preferably, it can be formed into a preformed compact by cold isostatic pressing, and then loaded into the container. The containers are evacuated and sealed prior to loading in the HIP. As shown in FIG. 13, the hot isostatic process relies upon having the desired pressure applied to the container as the container is heated to initiate a reaction in the compact. This is similar to the hot pressing method previously described; however, there are some advantages. Notably, HIP'ing can be used to fabricate near-net shapes, and can also be used to produce much larger parts than are possible in a hot press.

$Fe_3Al$ materials have been produced by the HIP process, including alloys containing Cr. The materials produced by this HIP process may exhibit significantly higher strength than what has been achieved by other fabrication methods.

Thus, iron aluminides of $Fe_3Al$ and FeAl can be fabricated in accordance with the invention by heating elemental powder compacts to initiate an exothermic reaction. Compound synthesis occurs within minutes during rapid compact heating that results from the formation and outward spreading of a transient liquid phase from sites occupied by aluminum particles. Although the invention has been described in a preferred embodiment in which Fe and Al powders are processed to form aluminide compounds, as will be apparent to those skilled in the art, certain changes and modifications can be made without departing from the scope of the invention as defined by the following claims.

What is claimed is:

1. A process for synthesizing iron aluminides from elemental powders comprising:

mixing Fe and Al powders in a ratio which approximates the stoichiometric composition of an iron aluminide compound;

forming a compact from the mixed Fe and Al; and heat treating the compact by heating to near the melting temperature of aluminum such that an exothermic reaction is initiated characterized by melt formation of Al accompanied by exothermic heating due to chemical mixing of Fe and Al to form an iron-aluminide compound.

2. The process as recited in claim 1 and wherein: heat treating is accomplished at atmospheric to a negative pressure (pressureless sintering).

3. The process as recited in claim 1 and wherein: heat treating is accomplished during compression of the compact (hot pressing).

4. The process as recited in claim 1 and wherein: heat treating is accomplished during hot isostatic pressing (HIP).

5. The process as recited in claim 1 and wherein: Fe and Al are combined in a ratio of Fe-15.8 wt.% Al to produce an $Fe_3Al$ compound.

6. The process as recited in claim 1 and wherein: the iron-aluminide compound is FeAl and Fe and Al are combined in a ratio of Fe-32 wt.% Al.

7. The process as recited in claim 1 and wherein: the aluminum has a particle size of from about 3 to 30 μm.

8. The process as recited in claim 1 and wherein: the compact has a green density of from about 53 to 71 percent of theoretical density.

9. The process as recited in claim 8 and wherein: an alloying element is mixed with the Fe and Al.

10. The process as recited in claim 9 and wherein: the alloying element includes Cr.

11. The process as recited in claim 1 and wherein: heat treating is performed at a heating rate of about 10° to 50° C./min.

12. A process for synthesizing $Fe_3Al$ from elemental powders of Fe and Al comprising:

mixing Fe and Al powders having a particle size of from about 3 to 30 μm in a ratio of Fe-15.8 wt.% Al;

forming a compact from the mixed elements having a green density of from about 53 to 71 percent of theoretical density;

heat treating the compact to at least about 600° to 650° C. at a heating rate of from about 10° to 50° C./min.

whereby an exothermic reaction $3Fe+Al \rightarrow Fe_3Al$ is initiated to form $Fe_3Al$.

13. The process as recited in claim 12 and wherein: the compact is heat treated while being compressed (hot pressing) whereby an $Fe_3Al$ compound having a densification approximately equal to theoretical densification of $Fe_3Al$ is fabricated.

14. A product produced by the process of claim 13.

15. The process as recited in claim 12 and wherein: the compact is heat treated in a vacuum (pressureless sintering).

16. The process as recited in claim 12 and wherein: the compact is heat treated in a hot isostatic press (HIP).

17. The process as recited in claim 16 and wherein: the Fe and Al are mixed with an alloying element.

18. A process for synthesizing FeAl from elemental powders of Fe and Al comprising:

mixing Fe and Al powders having a particle size of from about 3 to 30 μm in a ratio of Fe-32 wt.% Al;

forming a compact from the mixed elements having a green density of from about 53 to 71 percent of theoretical density;

heat treating the compact to at least about 600° to 650° C. at a heating rate of from about 10° to 50° C./min;

whereby an exothermic reaction $Fe+Al \rightarrow FeAl$ is initiated to form FeAl.

19. The process as recited in claim 18 and wherein: the compact is heated while being compressed (hot pressing) whereby an FeAl compound having a densification approximately equal to theoretical densification of FeAl is fabricated.

20. A product produced by the process of claim 18.

21. The process as recited in claim 18 and wherein: the compact is heat treated in a vacuum (pressureless sintering).

22. A product produced by the process of claim 18.

23. The process as recited in claim 18 and wherein: the compact is heat treated in a hot isostatic press (HIP).

24. The process as recited in claim 18 and wherein: the Fe and Al powders are mixed with an alloying element.

25. A process for synthesizing iron aluminides from Fe and Al powders comprising:

mixing Fe and Al powders in a ratio which approximates the stoichiometric composition of an iron aluminide compound selected from the class consisting of $Fe_3Al$ or FeAl;

forming by compaction at pressures from 70 to 280 MPa a compact having a green density of from about 53 to 71 percent of theoretical density of the iron aluminide compound; and heating the compacts through the temperature to initiate an exothermic reaction in the range of about 600° to 1000° C.;

whereby chemical mixing of Fe and Al is initiated to form the iron aluminide compound.

26. A process as recited in claim 25 and wherein: heating of the compact occurs under a vacuum of about $1.3\times10^{-3}$ Pa.

27. A process as recited in claim 25 and wherein: heating of the compact is carried out in a horizontal tube furnace.

28. A process as recited in claim 25 and wherein: heating of the compact is carried out in a hot pressing die with pressures from about 10 to 70 MPa applied and maintained during heating.

29. A process as recited in claim 25 and wherein: heating of the compact is performed initially under a vacuum and then under a flowing inert gas.

30. A process as recited in claim 29 and wherein: heating of the compact involves heating in a furnace to about 400° C. under a vacuum of about 4 Pa then heating to about 1000° C. at about 20° C./min under flowing argon.

31. A process as recited in claim 25 and wherein: the compact includes approximately 100 g of powder material.

32. A process as recited in claim 25 and wherein: the compact includes about 2 g of powder material.

33. A process as recited in claim 25 and wherein: an alloying element is mixed with the Fe and Al powders.

34. A process as recited in claim 33 and wherein: the alloying element is Cr in the amount of 2-5 wt.%.

35. A process as recited in claim 25 and wherein: heating of the compact is with hot isostatic pressing (HIP).

* * * * *